US006948600B2

(12) United States Patent
Chuang

(10) Patent No.: US 6,948,600 B2
(45) Date of Patent: Sep. 27, 2005

(54) CARRIER BAG FETCHING STRUCTURE

(76) Inventor: Yao-Tang Chuang, PO Box 82-144, Taipei (TW)

( * ) Notice: Subject to any disclaimer, the term of this patent is extended or adjusted under 35 U.S.C. 154(b) by 81 days.

(21) Appl. No.: 10/400,884

(22) Filed: Mar. 28, 2003

(65) Prior Publication Data

US 2004/0188202 A1 Sep. 30, 2004

(51) Int. Cl.[7] ..... A45C 5/12; A45C 13/00; A45C 3/00

(52) U.S. Cl. ..... 190/109; 190/36; 150/116; 206/320; 206/583; 206/804

(58) Field of Search ..... 150/116; 190/102, 190/110, 27, 36, 109; 206/320, 583, 804; 383/906; 220/495.05

(56) References Cited

U.S. PATENT DOCUMENTS 1,586,248 A * 5/1926 Komura ..... 221/260
1,680,324 A * 8/1928 Danville ..... 206/250
2,646,875 A * 7/1953 Feder ..... 206/754
2,997,163 A * 8/1961 Tel-Wardi ..... 206/254
3,589,505 A * 6/1971 Burniski ..... 206/250
4,248,364 A * 2/1981 Anderson ..... 383/6
4,925,027 A * 5/1990 Roze ..... 206/387.15
5,088,602 A * 2/1992 Heyderman et al. ... 206/387.13
5,160,001 A * 11/1992 Marceau ..... 190/102
5,207,254 A * 5/1993 Fromm ..... 150/104
5,524,754 A * 6/1996 Hollingsworth ..... 206/320
5,529,184 A * 6/1996 Sadow ..... 206/320
5,676,223 A * 10/1997 Cunningham ..... 190/109
5,775,497 A * 7/1998 Krulik ..... 206/320
5,819,944 A * 10/1998 Terrasi ..... 206/534
6,105,764 A * 8/2000 Scicluna et al. ..... 206/320
6,382,377 B2 * 5/2002 Godshaw ..... 190/110
2002/0088726 A1 * 7/2002 Chou
2004/0112697 A1 * 6/2004 Scicluna

* cited by examiner

*Primary Examiner*—Sue A. Weaver
(74) *Attorney, Agent, or Firm*—Leong C. Li

(57) ABSTRACT

A fetching structure for a carrier bag essentially comprised of a support board fixed to the inner edge of the opening of the bag; one fixation band being each laterally provided on the surface of the supporting board; a penetration section not connected to the supporting board being provided on the fixation band; one end of a pull band penetrating through the penetration section and the other end being suspended; and the contents inside the bag being exposed out of the opening for easy fetch when the pull band being pulled up.

1 Claim, 5 Drawing Sheets

CARRIER BAG FETCHING STRUCTURE

BACKGROUND OF THE INVENTION (a) Field of the Invention

The present invention is related to a fetching structure for a carrier bag, and more particularly to one that provides easy access to fetch the contents of the bag by pulling up the bag to expose its contents out of the opening.

(b) Description of the Prior Art

To fetch an object inside a conventional carrier bag, the bag must be placed flat with its opening wide open. As illustrated in FIG. 1 of the accompanying drawings, a lap computer carrier bag 1 is placed flat, and a zipper 11 on the frame is fully pulled open before having one's hand to fetch a lap computer 12. However, the conventional bag is difficult to access. In the absence of a flat surface, one has to grab the bag with one hand and to fetch the lap computer 12 with another hand. Consequently the lap computer 12 winds up falling on the ground and damaged. While forcing to fetch the lap computer 12, one's fingernails, particularly in the case of a female user, are vulnerable to be damaged.

SUMMARY OF THE INVENTION

The primary purpose of the present invention is to provide a fetching structure for a carrier bag. To achieve the purpose, the structure is essentially comprised of a supporting board. A fixation band is each laterally provided on the surface of the supporting board at where close to both edges of the supporting board. A penetration section not connected to the supporting board is provided at where appropriately on the fixation band. One end of a pull band is connected to either lateral edge of the supporting band and penetrates through the penetration section to be suspended so to have both lateral edges of the supporting board to be connected to the inner edge of the opening of the carrier bag. When the pull band is pulled up, the contents inside the carrier bag is exposed out of the opening for easy fetch.

Another purpose of the present invention is to provide the supporting board in a carrier bag for containing a lap computer to allow easy fetch of the lap computer out of the carrier bag.

Another purpose yet of the present invention is to provide the supporting board in a knapsack or a luggage carrier for easy fetch of the contents inside the knapsack or the luggage carrier.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
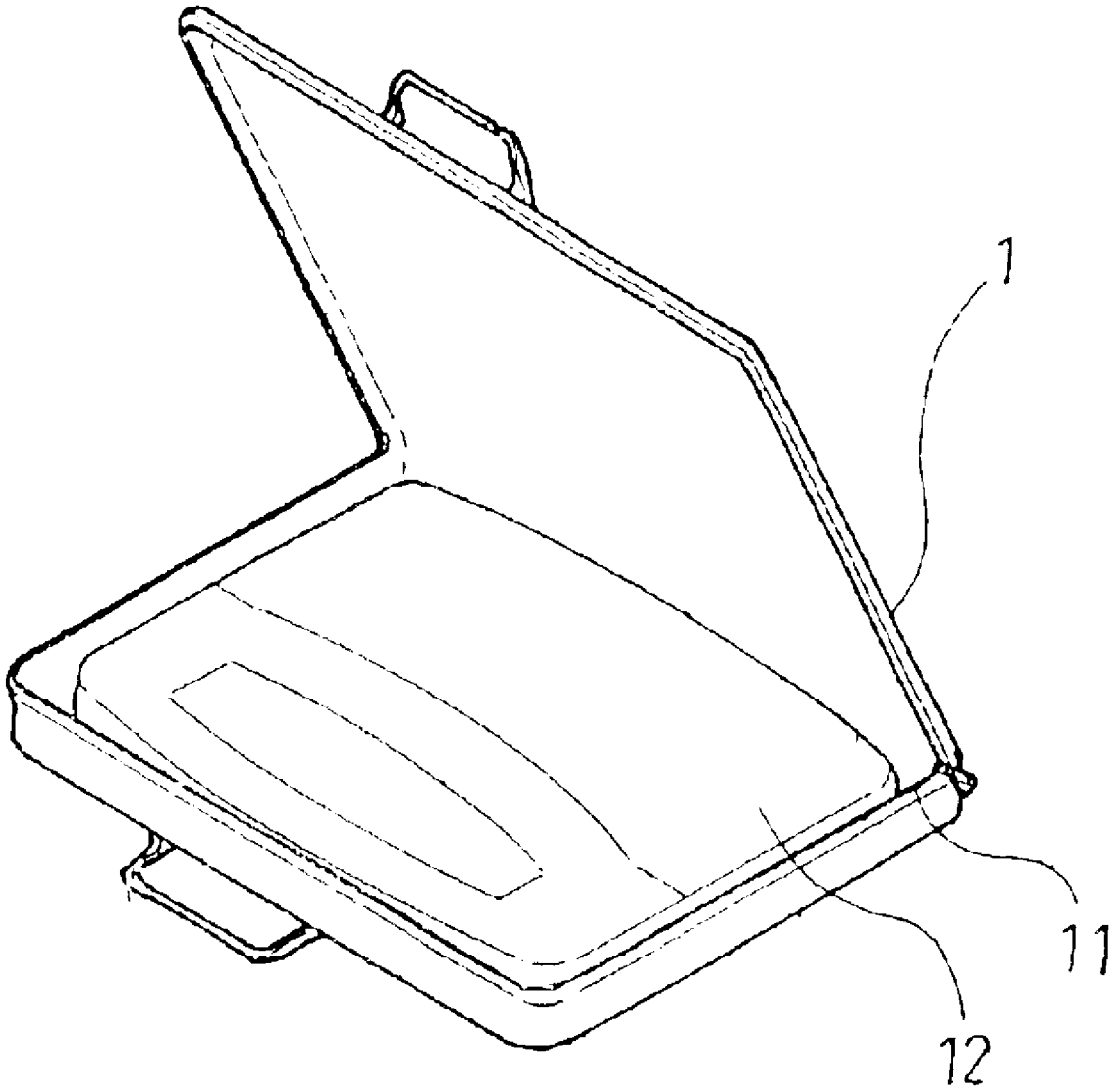
PRIOR ART FIG. 1
FIG. 1 is a perspective view of a carrier bag of the prior art for a lap computer.
Figure 2:
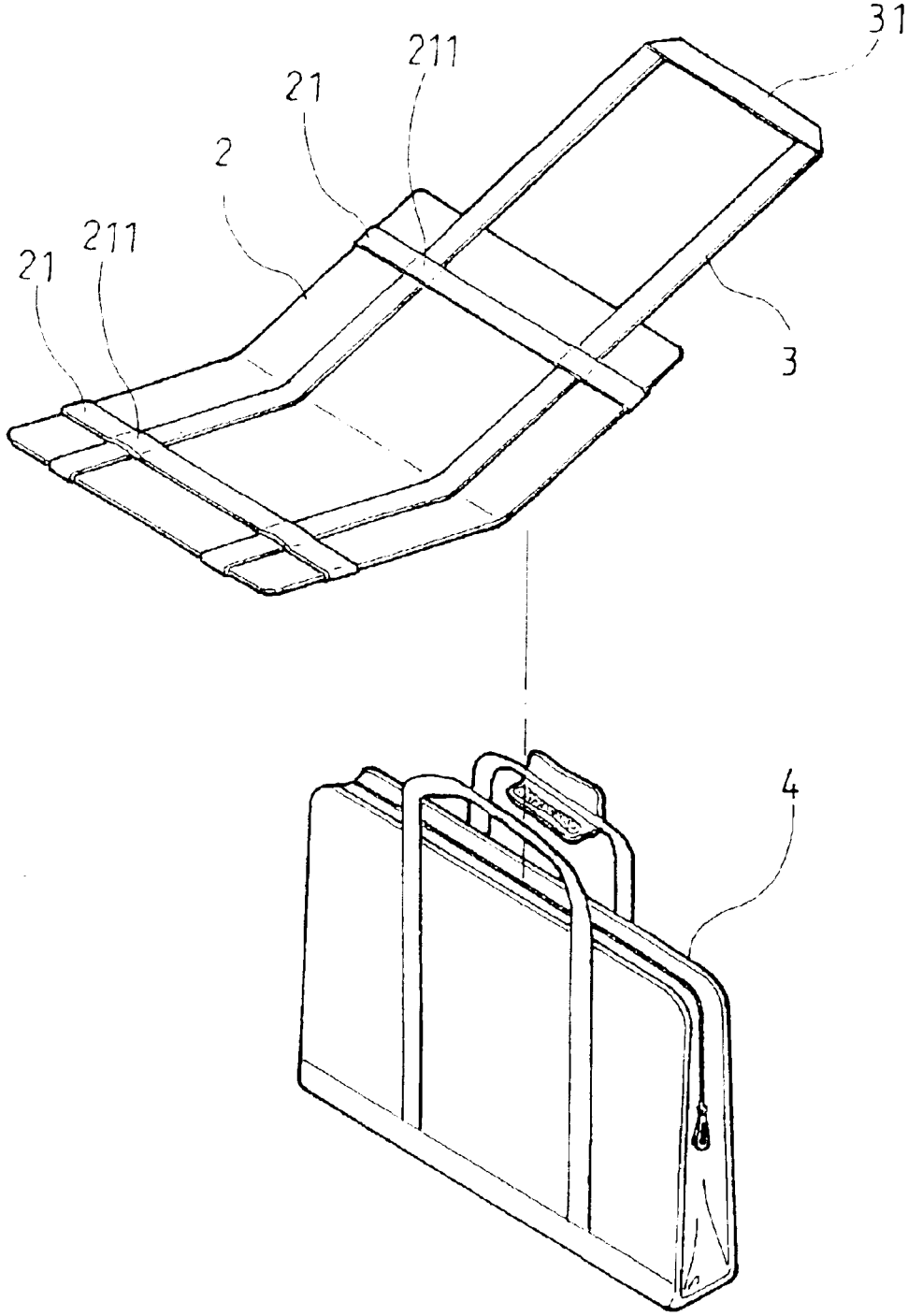
FIG. 2 is an exploded view of a preferred embodiment of the present invention.
Figure 3:
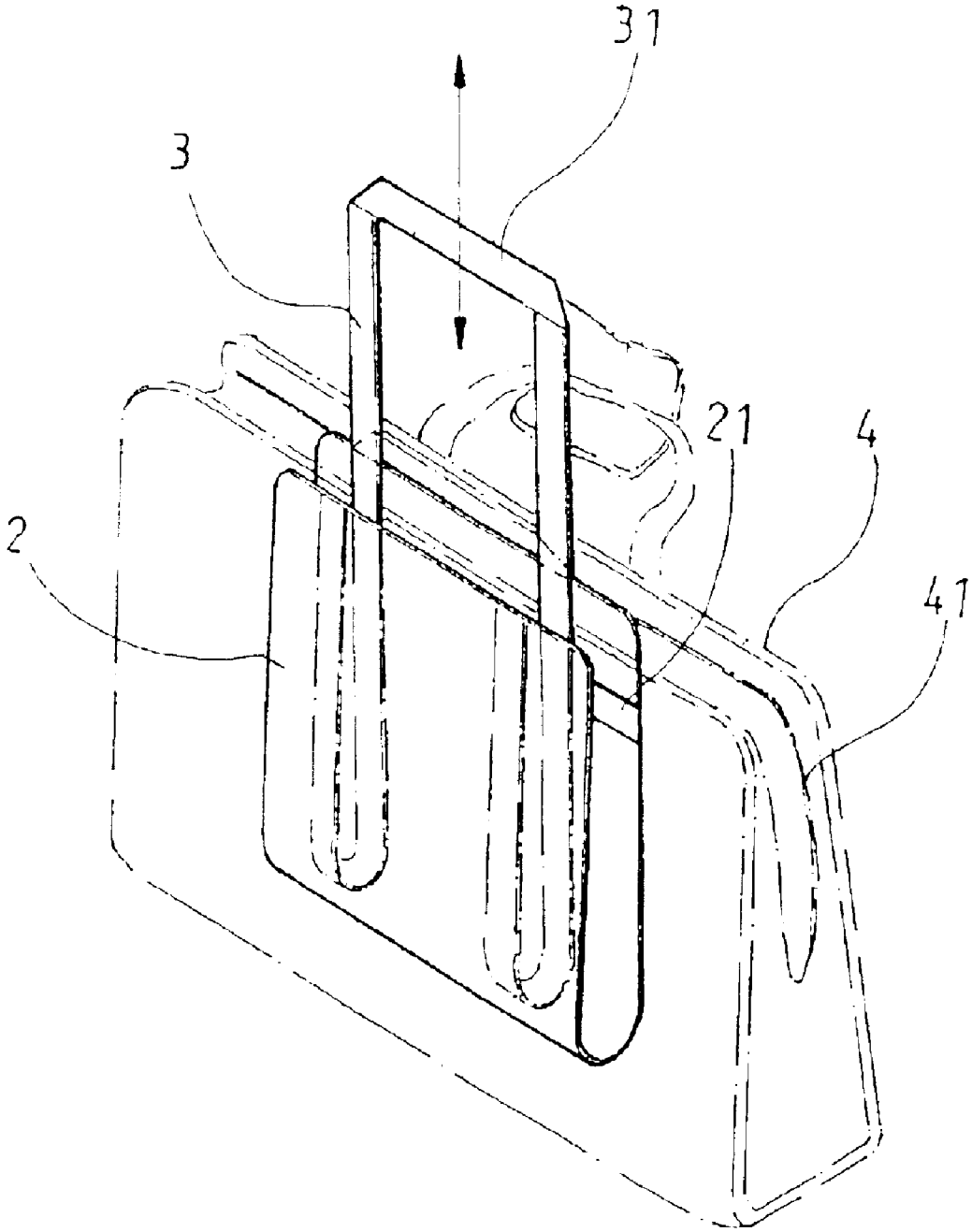
FIG. 3 is a perspective view of the preferred embodiment of the present invention as assembled.

Referring to FIGS. 2 and 3, a preferred embodiment of the present invention is essentially comprised of a rectangular supporting board 2. A fixation band 21 is each laterally provided on the surface of the supporting board 2 at where close to both edges of the supporting board 2. A penetration section 211 not connected to the supporting board 2 is provided at where appropriately on the fixation band. One end of a pull band 3 is connected and fixed to either lateral edge of the supporting board 2. The pull band 3 is then pulled through the penetration section 211 to have another end of the pull band formed a suspended section 31 for holding. Both lateral edges of the supporting board 2 are connected and fixed to the inner edge of the opening of a carrier bag 4, one for carrying a lap computer 5 in the preferred embodiment, so to expose the lap computer placed on the supporting board 2 inside the carrier bag simply by pulling up the pull band 3 to fetch of the lap computer 5.

Figure 4:
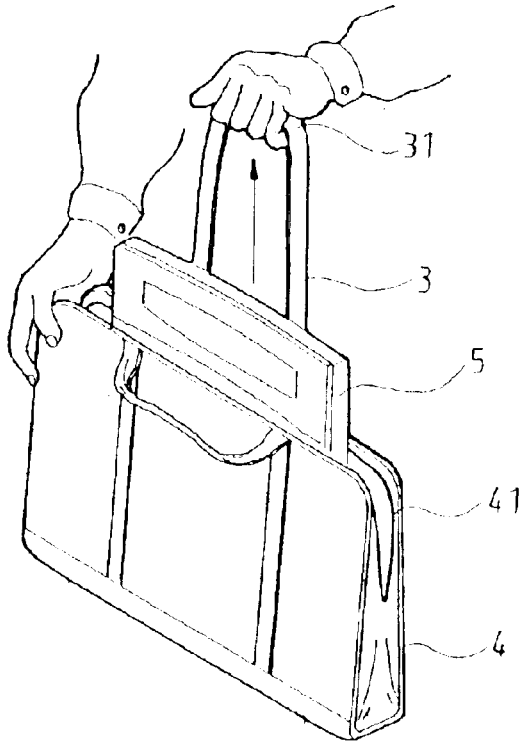
FIGS. 4 and 5 are schematic views showing another preferred embodiment of the present invention.

As illustrated in FIGS. 3 and 4, the lap computer 5 is placed at the bottom of the pull band 3 and supported by the supporting board 2. Upon fetching the lap computer 5, simply pull a zipper 41 opened up to a certain extent, and pull up the pull band 3 from the holding section 31. Since one end of the pull band 3 is fixed, the lap computer 5 is lifted up from the holding section 31 to expose the opening when the bottom of the pull band 3 is pulled up. The lap computer 5 can be easily fetched out of the bag without having to fully open up the zipper 41, and even at where a flat surface is not available.

Figure 5:
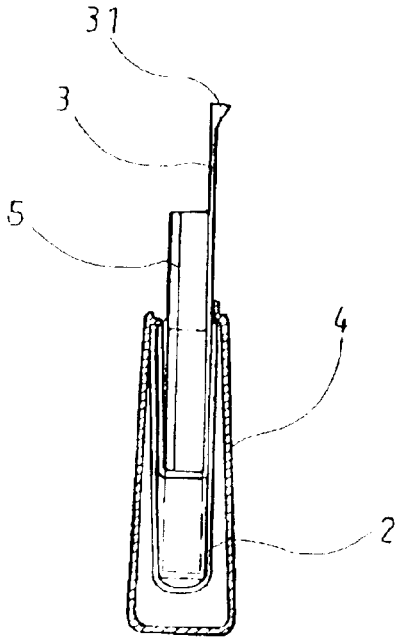
Figure 6:
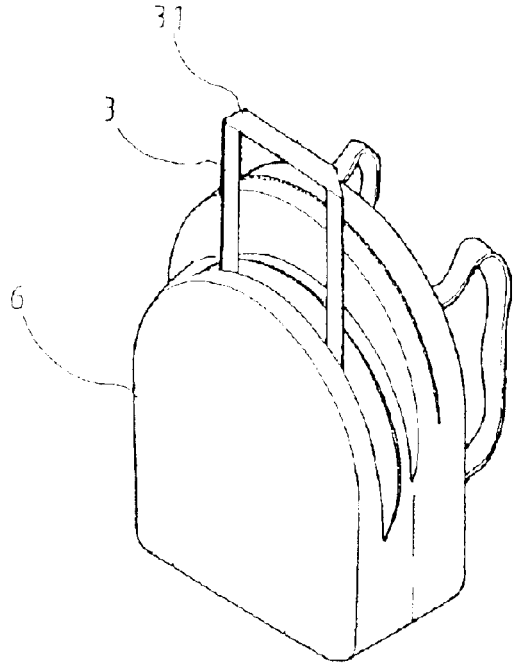
FIGS. 6 and 7 are schematic views showing another preferred embodiment yet of the present invention.
Figure 7:
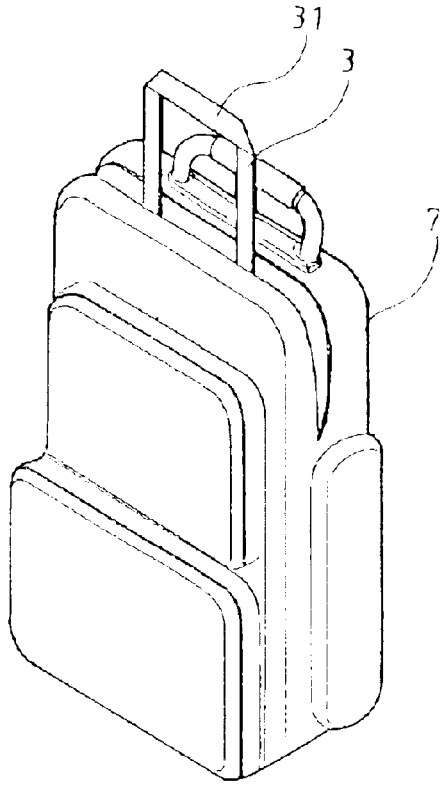

Now referring to FIGS. 5 and 6, the structure of the present invention is applied to a conventional knapsack 6 or a luggage carrier 7 to easily expose the contents, e.g., an important document with immediate access is required, simply by pulling up the pull band 3 without having to put flat the knapsack or the luggage carrier and to fully open up the zipper to fumble.

The present invention by providing a supporting board adapted with a pull band to permit the contents in a carrier bag forthwith to be exposed out of the opening of the bag for easy fetch, relates to an innovative and practical design. Therefore, this application is duly filed accordingly.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A fetching structure for a carrier bag comprising a rectangular supporting board, said rectangular supporting board having two first edges and two second edges, two fixation bands provided on a surface of said supporting board, each of said two fixation bands being located close to a respective one of said first edges of said rectangular supporting board, two penetration sections not connected to said rectangular supporting board being provided on said two fixation bands, a pull band having an end connected and fixed to one of said first edges of said rectangular supporting board, said pull band being pulled through said penetration sections to have another end of said pull band to form a suspended section for holding, said first edges of said supporting board being connccted and fixed to an inner edge of an opening of said bag axid contents inside said bag being exposed out of said opening for easy fetch when said pull band is pulled up.

* * * * *